United States Patent [19]

Schantz

[11] 4,179,907

[45] Dec. 25, 1979

[54] BIMETAL ACTUATED LOCKING DEVICE

[76] Inventor: Spencer C. Schantz, 5880 Anchorage Rd., Oconomowoc, Wis. 53066

[21] Appl. No.: 886,986

[22] Filed: Mar. 15, 1978

[51] Int. Cl.[2] ..... D06F 37/42

[52] U.S. Cl. ..... 68/12 R; 192/136; 210/146; 292/DIG. 69

[58] Field of Search ..... 307/328; 134/58 DL, 134/57 DL; 361/343, 344, 345; 34/55; 337/337, 334, 341; 192/136; 68/12 R, 23 R, 139; 292/DIG. 69; 210/146

[56] References Cited

U.S. PATENT DOCUMENTS

| | | | |
|---|---|---|---|
| 2,738,072 | 3/1956 | Knight | 192/136 X |
| 4,074,545 | 2/1978 | Case | 192/136 X |

*Primary Examiner*—John Gonzales

*Assistant Examiner*—James L. Dwyer

*Attorney, Agent, or Firm*—Wheeler, Morsell, House & Fuller

[57] ABSTRACT

An interlock device for the door of an appliance, such as a washing machine, to prevent operator access to the spin dryer drum while it is driven or coasting. The device comprises a switch and a bimetal element for being connected in a series circuit including a timer operated switch and the drum drive motor. A slotted latch member projecting from the door closes the switch when the door is closed and the motor becomes energized if the timer switch is closed. The bimetal is heated by motor current and causes a latch lever to engage and maintain engagement with the latch member until expiration of a delay period which exceeds the time required for the motor to coast to a stop.

11 Claims, 7 Drawing Figures

BIMETAL ACTUATED LOCKING DEVICE

BACKGROUND OF INVENTION

The new safety interlock device is for use in appliances such as household clothes washing machines and dryers for maintaining the access door locked at any time that a motor driven component such as the spin dry tub of a washing machine is being driven or is coasting to a stop. As is known, spinning for centrifugal drying is conducted at high speed and provides a chance for personal injury if it is accessible while still rotating.

A variety of systems are illustrated in the prior art for preventing opening of an access door while a component of an appliance such as a washing machine is in motion. One popular scheme is to use a mechanical latch which holds the door in closed position while at the same time actuating a switch that partially enables the motor circuit. A solenoid operator and latching mechanism is also provided for maintaining the cover latch locked until the solenoid is energized concurrently with de-energization of the motor in which case the latch becomes unblocked and can be released to open the door. An example of this basic approach is shown in U.S. Pat. No. 2,738,072.

The latter patent also shows another approach which is to use a bimetal element to effect latching and unlatching of an appliance cover or lid. The bimetal actuates a latch lever into selective engagement and disengagement with a hook latch element on the door. The bimetal element is adjacent a resistance heater element which is energized when the motor is energized and causes the bimetal element to effect latching of the cover. A separate switch is placed in a series circuit with the motor and this switch is closed when the door is closed. The bimetal heater is de-energized when the motor is de-energized by a timer switch which controls the drying cycle or by other means. When the bimetal has cooled sufficiently over an interval following termination of motor current, the bimetal is effective to unlatch the latch element and permit opening of the door. While the door is open, the switch is open so the motor is always prohibited from operating at this time.

Other examples of electromechanical or solenoid operated interlock mechanisms are illustrated in U.S. Pat. Nos. 2,618,282; 2,896,641 and 2,936,892. The solenoid operated cover lock devices shown in the prior art employ a large number of fixed and movable parts and are therefore costly and complex. Generally, they are not unitary devices which can be mounted easily and in a single operation during assembly of the appliance. The prior interlock mechanisms usually require mounting a switch in one location, a solenoid operator in another, a latch in another and then assembling linkages and springs to complete the mechanism. As is well known to those involved in manufacture of appliances, the cost of manufacturing and installing the multiple element interlock mechanisms has been unduly high. Moreover, their complexity increases the statistical probability of failure during the life of the appliance.

SUMMARY OF INVENTION

The present invention provides an interlock device which includes a switch for being connected in series circuit with a motor and a thermally controlled latching element which is mounted to a common base with the switch and can be installed as an entity in an appliance.

The interlock device has a cover latching lever whose position is controlled exclusively with a bimetal element that is connectable directly in a series circuit with the motor and in which a cantilevered bimetal element has a free end slidably connected to an insulating block on one end of the latching lever to cause pivotal or rotational motion of the latching lever upon energization of the motor which drives the rotating appliance component. The bimetal can be connected in series with the entire motor load, i.e. both start and run windings. It is preferable in some arrangements to have the bimetal only in series with the run winding to prevent overheating and thus thermal destruction of the bimetal caused by rapid and successive on-off cycling of the motor.

An object is to provide a controlled amount of thermal insulation on the bimetal element for governing the time which it takes for the bimetal to cool after it is de-energized so as to produce a predetermined time delay during which the moving component will assuredly coast to a stop before the door can be unlatched.

Another object is to make the base from a single piece of metal plate and to have a part of the base that is integral with it serve as a mounting pad for the pivotal thermally controlled latching lever.

Another object is to provide suitable openings in the base to provide clearance for electrical connections to the switch so that use of other insulation to provide isolation may be obviated.

Another important object is to use the first end of the bimetal element to actuate the latching lever and to support the second end of the bimetal element on terminals mounted in an insulating block along with a mechanical support for the second end of the element and to so arrange the terminals and support that adequate electrical isolation is obtained in a minimum amount of space and with the use of a minimum volume of insulating material.

In general terms, the new unitary door interlock device comprises a base formed from a metal plate to have a bottom wall and a side wall which are perpendicular to each other or L-shaped in cross section. Thus, the base has an open top, side and ends and is adapted for mounting on the appliance. An extension is formed integrally from one end of the bottom wall and a latching lever is pivotally mounted on the top for swinging in a plane that is parallel to the plane of the bottom wall and about an axis that is perpendicular to the bottom wall. One end of the latching lever is free to swing into and out of engagement with a slotted latch element that projects from the appliance access door. The other end of the latching lever, inboard of the base, has a block of insulating material fastened to it. Another block of insulating material is fixed in the other end of the base and a bimetal element is interposed between the two blocks. When the bimetal element is conducting or has recently conducted motor current, the bimetal deflects and swings the latching lever into locking engagement with the projecting element to lock the previously closed door.

A switch and a pivotal switch operating arm are mounted on the side wall of the base. The switch operating arm pivots about an axis that is perpendicular to the side wall and swings in a plane parallel to this wall or, in other words, swings orthogonally to the latching lever.

The projecting latching element closes this switch to energize the motor provided a timer or function cycling switch is also closed as would be the case when a clothes washing machine has reached the spin drying phase of its cycle. This causes the bimetal element to deflect immediately so the latching element locks the door. The door remains latched and inoperable until the motor has been de-energized long enough for the bimetal element to cool and deflect oppositely. This delay period precludes access to the driven component, such as the spin dry tub in a washing machine, until the tub has assuredly coasted to a complete stop.

An interlock device that is similar in many respects to the device shown and described herein may be seen in U.S. patent application, Ser. No. 718,056, filed Aug. 26, 1976, in the name of Richard P. Case, now U.S. Pat. No. 4,074,545, dated Feb. 21, 1978. The versions of the device disclosed in the pending application and this application are the result of a mutually cooperative effort. Hence, only the novel features contributed by the inventor in this application are intended to be claimed herein.

How the above mentioned objects and other more specific objects are achieved will become evident in the more detailed description of an embodiment of the new interlock device which will now be set forth in reference to the drawings.

DESCRIPTION OF A PREFERRED EMBODIMENT

Figure 1:
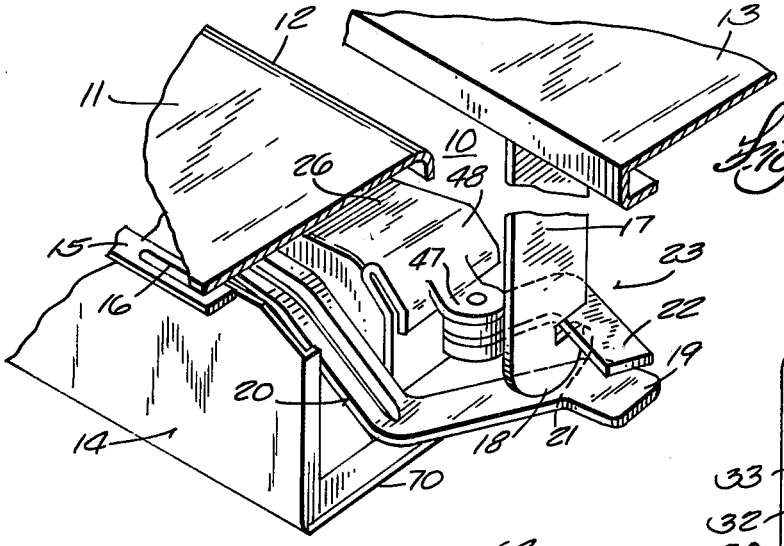
FIG. 1 is a perspective view of the new appliance door interlock device associated with an appliance housing and access door which are shown fragmentarily.
Figure 7:
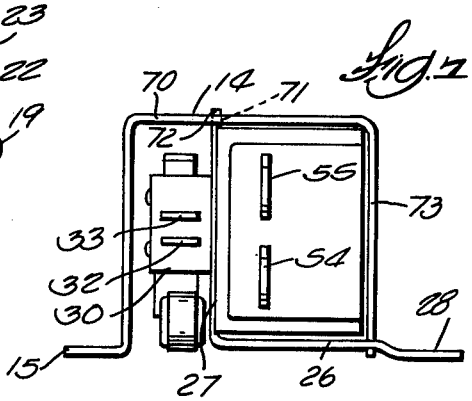
FIG. 7 is an end view taken along line 7—7 of FIG. 3.

In FIG. 1, the interlock device is generally designated by the numeral 10 and is fastened underneath the edge of a fragmentarily shown top panel 11 of the housing for an automatic clothes washer or dryer machine. Edge 12 of the housing is the margin of an opening which allows access to the interior of the machine and to a motor driven component such as the spin dryer drum, not shown, which turns at high speed to dry clothes by centrifuging during one phase of the machine operating cycle. This opening should be closed during machine operation by a door 13, a fragment of which is shown, to prevent the hazard of the user becoming entangled with clothes on the drum when it is still rotating. The interlock device has a cover 14 from which a flange 15 having elongated holes 16 extends. The device may be fastened to panel 11 with flanges 15 or 28, or both, which extend from its base as will be described a little later. The manner in which the cover cooperates with the base will also be described in more detail later.

Access door 13 in FIG. 1 has a latch element 17 fixed to it and projecting from it in the general direction in which the door is swung or moved to close the access opening to the spin dryer drum. The tip 18 of latch element 17 applies force to the free end of a switch operating arm 19 when the door arrives in closed position. This deflects arm 19 which closes a switch that enables the dryer tub spinning motor to run if other conditions are met as will be described later.

Latch element 17 has a notch or slot 21 which is for permitting element 17 to be engaged by an edge of the free end 22 of a thermally controlled latching lever 23 which swings in a plane that is orthogonal to the plane in which the switch operating lever 20 swings. As will be seen, if the drum motor is running or has been running recently, the thermal control is such that latching lever 23 will be urged into engagement with latch element 17 to thereby lock door 13 closed, but after expiration of a time delay sufficient for the rotating dryer drum to coast to a stop, the latching lever disengages automatically and the door 13 can be opened for safe access.

The specific construction of the interlock device will now be described in reference to FIGS. 2, 3 and 4 which show different views of it. As seen best in FIG. 3, the device has a mounting base composed of a generally planar bottom wall 26 and an upstanding side wall 27. The base is formed from a single piece of metal plate and has an L-shape when viewed from either end. A mounting flange 28 projects integrally from the edge of bottom wall 26 and the flange has a pair of holes 29 for mounting it with screws or other fasteners to the bottom of top panel 11 of the machine, for example. As mentioned earlier, the device obtains further support by fastening cover flange 15 to the machine. The manner in which the cover 14 interlocks with walls 26 and 27 of the base will be discussed later.

Figure 2:
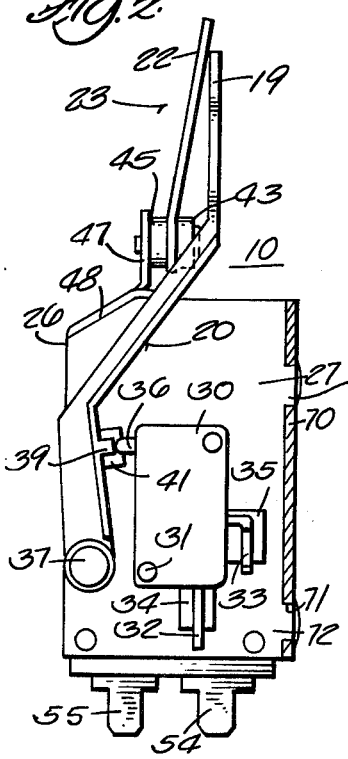
FIG. 2 is a view of one side of the unitary interlock device showing, in particular, how the switch and its operating arm are mounted on the outside of the base side wall and how the door latching lever is mounted to an extension from the bottom wall of the base.
Figure 3:
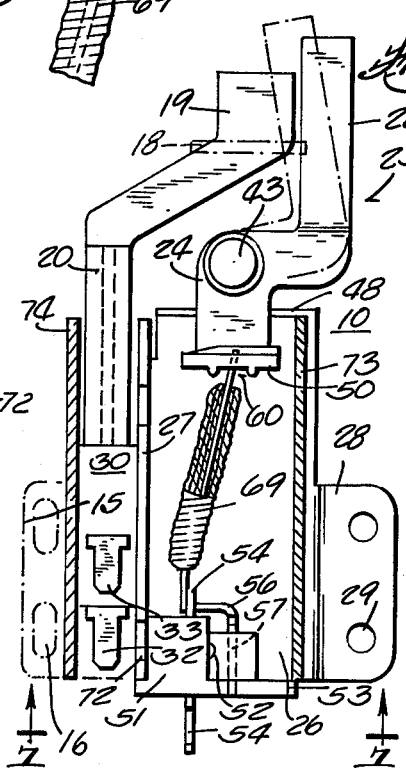
FIG. 3 is a plan view of the device with a wall of its cover shown in section, the latching lever being shown in solid lines in its non-latching position and in phantom lines as in its latching position.

FIGS. 2 and 3 show a snap-action normally open switch 30 mounted to the outside of base side wall 27 with fasteners such as two rivets 31. The switch contacts and the internal toggle mechanism which provides the snap-action are not visible in this view. A pair of terminals 32 and 33 project from the switch. As seen in FIGS. 2 and 3, terminals 32 and 33 are shaped for being connected by spade type connectors, not shown. Instead of interposing insulation between terminals 32 and 33 to preclude contact between electrified spade terminals and base wall 27, wall 27 is provided with punched out openings 34 and 35 adjacent terminals 32 and 33, respectively, so there is not metal nearby to defeat electrical isolation.

A plunger or operating pin 36 projects from switch 30. The mechanism within the switch includes a spring, not shown, which biases plunger 36 in a direction outwardly of the switch. When pin 36 is depressed, the switch is closed and when it extends as shown in FIG. 2, the switch is open. Plunger 36 is actuated with a switch operating arm 20 which is journaled for pivoting on a headed stationary pin 37 which has its end opposite of its head end reduced in diameter to facilitate fastening it to side wall 27 by swaging as indicated by the numeral 38 in FIG. 4. Operating arm 20 has a cam 39 projecting from it for applying operating force to switch plunger 36. Adjacent cam 39 is a small stop 40, see FIG. 4, which projects from switch operating arm 20 into a rectangular opening in the base side wall 27. This prevents operating arm 20 from swinging away from the switch and assures that the free play between cam 39 and plunger 36 is held to a minimum so a very small swinging movement of arm 20 will actuate the switch. Moreover, use of the arm stop 40 enables avoiding use of a separate spring to keep the cam in contact with switch plunger 36 and the spring in the switch which holds the plunger out and the switch open can be taken advantage of to keep the operating arm biased away until it is overcome by the superior force applicable by latch element tip 18 acting on operating arm 20.

The configuration of the thermally actuated door latching lever 23 is most apparent in FIG. 3 where it can be seen to comprise two parts, a latch engaging blade part 22 and a part 24 which is offset from part 22. Latching arm 23 is preferably stainless steel and is mounted for pivoting on a stainless steel headed pin 43 and is accurately and stably positioned on the pin with a pair of plastic spacer rings or washers 44 and 45 as can be seen in FIG. 4. The pin 43 is stepped at 49 and the end of pin 43 most remote from its head is secured by swaging it as at 46 to a tab 47 which is the terminus of a narrow strip 48 that extends from and is formed integral with one end of bottom base wall 26. The plastic rings 44 and 45 and stainless steel pin 43 provide a stable corrosion resistant pivotal connection for the latching arm 23 and isolate the arm 23 from the tab 47 which is ordinary carbon steel and subject to corrosion. This arrangement eliminates failure caused by corrosion. The moisture, detergents, bleach, etc. used in such machines creates a highly corrosive environment for mechanical parts.

A block of insulating material 50 is fastened on the end of part 24 of latching lever 23. Another block of insulating material 51 is secured to the side wall 27 by any suitable means such as rivets. A head 52 of one of the rivets can be seen in FIG. 3. Block 51 has an integrally extending riser 53 which serves to close the end of the L-shaped base which is comprised of bottom wall 26 and side wall 27. Two electrical terminals 54 and 55 extend through block 51. Another Z-shaped support element 56 has one of its ends 57, shown in dashed lines in FIG. 3, embedded in block 51. Blocks 50 and 51 may be molded of a suitable resin. The inner ends of terminals 54 and 55 and element 56 are marked 54', 55' and 56', respectively.

A bimetal element 60 is cantilevered from its connection to terminals 54', 55' and 56' and bridges between fixed block 51 and block or coupling 50 on the latching lever. As can be seen in FIG. 4, bimetal element 60 comprises a sequence of bimetal strips arranged adjacent each other and in substantial parallelism with each other. The two inside strips are continuous at their first ends and are fastened to metal support element 56' by welds or rivets. The first ends of the two outside strips are respectively riveted to the inner ends 54' and 55' of the terminals. The second ends 62 and 63 are continuous with the ends of the intermediate strips so that the bimetal element 60 as a whole has a zig-zag or serpentine configuration. Bimetal element ends 62 and 63 have integral fingers 64 and 65 extending from them. Each of the fingers fits in a tapered hole or slot 66 in insulating block 50 as shown in detail in FIG. 5. Thus, when the bimetal element 60 deflects in the opposite direction as a result of heating when passing the drum drive motor current and of cooling when current flow is discontinued, the latch lever 23 will be rocked back and forth between its solid line position in FIG. 3 and its phantom line position, with the fingers 64, 65 sliding or shifting in the slots as the block 50 moves with the lever 23. The tapered lead-in of the holes or slots 66 facilitates the movement of the fingers 64 and 65 during sliding motion within the slots. Thus the lost motion connection affords movement between the fingers and block 50 to accommodate the movement of the block 50 with the lever 23.

It should be noted that mounting of bimetal element 60 on insulating block 51 is achieved in a manner that prevents zig-zag shaped bimetal element 60 from warping laterally so that no spurious deflection of the element occurs. Moreover, the terminals 54 and 55 and the intermediate support 56 for the bimetal are arranged for optimizing electrical isolation between the parts. This results from intermediate support 56 being Z-shaped so that its embedded end 57 can be set in a plane within block 51 that is spaced from the plane of terminals 54 and 55.

Figure 5:
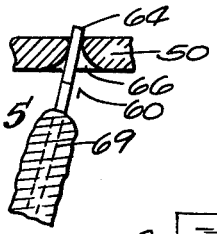
FIG. 5 is a fragmentary view showing how the bimetal element is pivotally connected with the insulating material block through which the bimetal element drives the latching lever.
Figure 4:
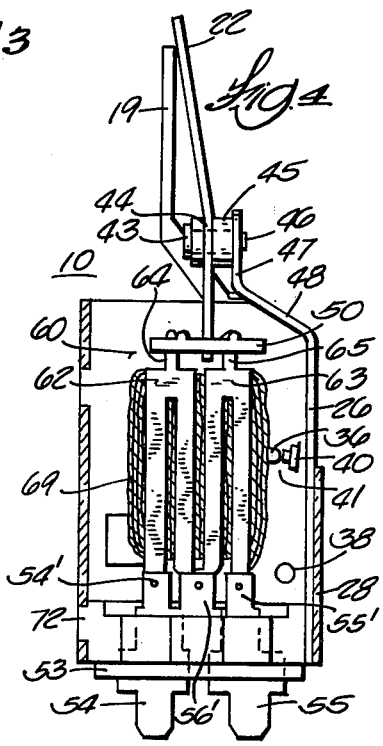
FIG. 4 is a view taken from the right side of FIG. 3 showing the wall of the device cover in section.

FIGS. 3–5 show how the bimetal element 60 is wrapped with thermal insulating material 69, primarily for controlling its cooling and, hence, its return deflection rate. The thermal insulation 69 may be in the form of a strand composed of fine glass filaments which strand is wound around the bimetal element.

The device is provided with a cover 14, previously mentioned, which is U-shaped in cross section and is adapted for being joined with the base. As can be seen in FIG. 2, the cover has top wall 70, shown in section, which has slots 71. A pair of tabs 72 extend from an edge of side wall 27 of the base. These tabs register in the slots 71 and are staked or deformed to secure the cover to the base. One of the side walls 73 of the cover appears in section in FIG. 3. Its lower edge, not visible, has tabs similar to 72 which project into complementary slots in the bottom wall 26 of the base. The top wall 70 of the cover also appears in section in FIG. 4. The other side wall 74 of the cover appears in FIG. 3 in section. It carries mounting flange 14 and is spaced from side wall 27 of the base to provide a channel in which switch 30 and its operating arm 20 are protected. In FIG. 3, the top of the cover is omitted because of sectioning but it will be understood to extend in a plane parallel to the paper between cover wall 74 and cover wall 73.

Figure 6:
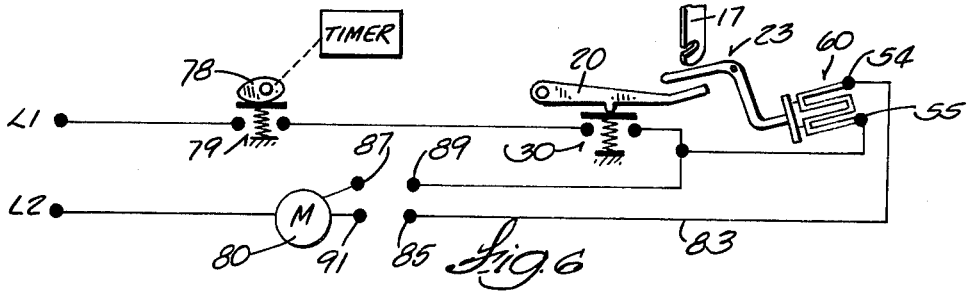
FIG. 6 is a schematic diagram of a washing machine circuit in which the new door interlock device is incorporated.

A typical circuit in which the new interlock device may be used is illustrated in FIG. 6. Its terminals L-1 and L-2 are connected across an a-c power source. The circuit includes a timer which operates a cam 78. The cam may close a switch 79 at a time for the spin dry phase of the washer to start. The motor for driving the spin dry tub is marked 80. Switch 30 and bimetal element 60 of the interlock device are connected in a series circuit with timer switch 79 and motor 80. In one embodiment, all current supplied to the motor flows through the bimetal element through lead 83 when terminal 85 of lead 83 is connected to the motor start winding terminal 87 and terminal 89 is not connected to the motor. This arrangement may be satisfactory for some applications. If the motor has separate start and run windings, as are typically employed in the motors of large appliances, it is preferred to connect terminal 89 to the start winding terminal 87 and terminal 85 to the run winding terminal 91. With the bimetal 54 in series with only the motor 80 run winding, the possibility of overheating the bimetal by rapid and repetitious switching of the appliance motor 80 on and off is minimized. With the bimetal 60 in series with the entire motor load, the excessive starting currents can overheat the bimetal 60 and cause thermal destruction and distortion of the bimetal 60.

The appliance motor 80 normally includes an integral motor load protector in leg L2 of the circuit. With a motor load protector the bimetal element 60 and the motor load protector are sized so that the motor load protector will open the circuit at a current and overload time prior to overheating of the bimetal element 60. For example, the motor load protector can be sized to interrupt the circuit where there is a 16 amp. load for 15 seconds on the bimetal. This would provide an adequate safety margin for the selected bimetal element. The overload protector would actually be rated at 30 amp. 70 volts and 15 seconds inasmuch as the overload motor protector handles the entire motor current for both the start and run windings.

In operation, with both circuit arrangements, when door 13 of the machine closes, the latch element 17 which projects from it acts on switch arm 20 to close switch 30. If the timer switch 79 is closed at this time, motor 80 will run and its current will be conducted through bimetal element 60 causing latching lever 23 to latch in the slot of latch element 17. This prevents the door from being opened. If the timer switch 79 opens or if the circuit is interrupted by other means, bimetal 60 begins to cool and eventually deflects to the condition where it will cause latching lever 23 to unlatch. The delay period between current interruption and release of the door is governed by the rate at which the bimetal element 60 cools and this, in turn, depends on the extent to which it is thermally insulated. The cooling rate should be established so that the door will remain latched at least until the spin dryer tub has coasted to a stop.

I claim:

1. A safety interlock device for use with an appliance including housing means, a motor, a component in said housing means driven by said motor, a movable door on said housing means which when closed and opened prohibits and permits access, respectively, to said component, said device comprising:

base means mounted on one of said housing means and said door, projection means on the other of said housing means and said door, a switch mounted on said base means and a switch operating arm mounted pivotally on said base means for moving in a first plane, said switch being caused to close when said projection means moves said arm in one direction due to closure of said door and said switch being caused to open when said projection means allows said arm to move in another direction due to opening of said door, a latch lever mounted on said base means for pivoting in a second plane alternately into latching engagement with and disengagement from said projection means, a first insulating member fastened to said latch lever, a bimetal element comprised of a sequence of bimetal strips arranged adjacent and in substantial parallelism with each other and each having a first and second ends, the second ends of adjacent strips being interconnected and the first ends of alternate adjacent strips being interconnected and the first ends of a pair of strips most remote from each other being separated from adjacent strips and constituting the terminal ends of a series electric circuit through said bimetal element, said bimetal means deflecting in response to being heated by electric current passing through it, a second insulating member on said base on which said bimetal element is fixedly supported from its first end, said motor, said switch, and said bimetal element forming a series circuit for being connected across an electric power supply, means extending from the second ends of said bimetal element for engaging said first insulating member to cause said latch lever to swing in response to deflection of said bimetal element so said latch lever will engage said projection means and prevent opening of said door when said bimetal element is heated by current flowing through said series circuit and will disengage said projection means and permit opening of said door when said bimetal element is cooled due to interruption of said current for a predetermined amount of time, and insulation means covering part of said bimetal element to control the rate of cooling of said bimetal.

2. The device as in claim 1 wherein said heat insulating means is a strand of insulating fibers wrapped around said bimetal element.

3. The device as in claim 1 wherein:

said second insulating member for fixedly supporting said bimetal element from its first end is a solid block of insulating material fixed to said base, at least a pair of laterally spaced apart connector members supported in said second insulating member, said connector members each having corresponding first ends extending from one side of said block and corresponding second ends extending from the other side of said block, said terminal ends of said bimetal strips being fastened to said corresponding first ends to put said bimetal element in circuit between said connector members, and wherein said connector members lie in a first plane, and a unitary support element having first and second portions which are offset from each other and a third portion interconnecting said first and second portions and being generally perpendicular thereto, said second portion being secured in said second insulating member in a plane other than said first plane and said first portion being fastened to said first end of said bimetal element between said terminal ends.

4. In combination, a safety interlock device comprising a base, a locking lever and pivot means pivotally connecting said locking lever to said base, an insulative coupling fixed to one end of said locking lever, an insulative support block spaced from said pivotal connection of the locking lever, a bimetal element cantilevered from said insulative support block and extending between said support block and said insulative coupling, and cooperating means on said bimetal and said coupling to connect said bimetal to said locking lever to afford rotary displacement of said lever about said pivot upon thermal action of said bimetal and to afford relative movement of the adjacent end of said bimetal relative to said coupling, and an electric motor having a start winding and run winding, terminals for said windings and apparatus driven by the motor, a circuit connecting said bimetal element in series with said run winding to minimize the possibility of overheating the bimetal by repetitious switching on and off of said motor, said circuit including an electrical switch, first and second line voltage terminals, a lead connecting said first line terminal to a terminal on said motor connected to both of said run and start windings, a lead connecting the other terminal of said run winding to one side of said bimetal, a lead connecting the other side of said bimetal to one side of said switch and a lead connecting the other side of said switch to said second line terminal, and a lead connecting the other start winding terminal to the common connection of said switch and said bimetal.

5. A safety interlock device in accordance with claim 4 wherein said pivot means comprises a non-corrosive headed pin, plastic washers arranged around said pin and isolating said locking lever from said base and spacing said locking lever intermediate the length of said pin.

6. A safety interlock device in accordance with claim 4 wherein said bimetal is insulated to control the rate of cooling thereof.

7. The combination of claim 4 wherein said motor has a motor load protector and wherein said motor load protector and said bimetal are selected so that said motor load protector opens said circuit to said bimetal before overheating of said bimetal.

8. A bimetal actuated device comprising a base, a lever, pivot means pivotally connecting said lever to said base, an insulative coupling fixed to one end of said locking lever, an insulative support block spaced from said pivotal connection of the locking lever, a bimetal element cantilevered from said insulative support block and extending between said support block and said insulative coupling, and cooperating means on said bimetal and said coupling to connect said bimetal to said lever to afford rotary displacement of said lever about said pivot upon thermal action of said bimetal and to afford relative movement of the adjacent end of said bimetal relative to said coupling and including insulation around said bimetal to control the rate of heating and cooling.

9. A device in accordance with claim 8 wherein said cooperating means comprises a slot in said block and a finger on said bimetal, said finger freely interfitting in said slot.

10. A device in accordance with claim 8 in combination with an electric motor having a start winding and a run winding and apparatus driven by the motor, and a circuit connecting said bimetal element in series with said run winding.

11. The combination of claim 10 wherein said motor has a motor load protector and wherein said motor load protector and said bimetal are selected so that said motor load protector opens said circuit to said bimetal before overheating of said bimetal.

* * * * *